US010294590B2

(12) United States Patent
Wu

(10) Patent No.: US 10,294,590 B2
(45) Date of Patent: May 21, 2019

(54) WOVEN CLOTH

(71) Applicant: Tsung-Jung Wu, Taichung (TW)

(72) Inventor: Tsung-Jung Wu, Taichung (TW)

( * ) Notice: Subject to any disclaimer, the term of this patent is extended or adjusted under 35 U.S.C. 154(b) by 80 days.

(21) Appl. No.: 15/644,304

(22) Filed: Jul. 7, 2017

(65) Prior Publication Data

US 2019/0010635 A1 Jan. 10, 2019

(51) Int. Cl.

| | |
|---|---|
| ***D03D 15/08*** | (2006.01) |
| ***D03D 15/00*** | (2006.01) |
| ***D03D 1/00*** | (2006.01) |
| ***A43B 23/02*** | (2006.01) |

(52) U.S. Cl.

CPC ..... *D03D 15/08* (2013.01); *A43B 23/0205* (2013.01); *A43B 23/027* (2013.01); *D03D 1/00* (2013.01); *D03D 15/0083* (2013.01)

(58) Field of Classification Search

CPC ..... D03D 27/00; D03D 3/02; D03D 11/00; D03D 11/02; D03D 19/00; D03D 2700/60; D03D 27/12; D03D 1/00; D03D 3/06; D03D 47/06; D03D 25/005; D04B 21/14; D04B 21/06; D04B 21/10; D04B 21/16; D04B 21/18; D04B 25/12; D04B 21/12; D04B 21/165; D04B 27/02

See application file for complete search history.

(56) References Cited

U.S. PATENT DOCUMENTS

| | | | | |
|---|---|---|---|---|
| 3,654,056 A * | 4/1972 | Nisbet et al. | D05C 17/02 | 28/140 |
| 4,048,399 A * | 9/1977 | Terzaghi | H01M 4/765 | 429/141 |
| 4,189,931 A * | 2/1980 | Groshens | D04B 21/14 | 66/193 |
| 4,333,321 A * | 6/1982 | Schneider | D04B 21/02 | 66/192 |
| 4,344,463 A * | 8/1982 | Muller | D03D 47/06 | 139/117 |
| 4,500,578 A * | 2/1985 | van de Kamp | B66C 1/18 | 428/102 |
| 4,581,905 A * | 4/1986 | Bonaschi | D04B 25/12 | 66/203 |
| 4,589,450 A * | 5/1986 | Eisenlohr | D03C 7/06 | 139/54 |

(Continued)

FOREIGN PATENT DOCUMENTS

TW M455021 U 6/2013

*Primary Examiner* — Robert H Muromoto, Jr.
(74) *Attorney, Agent, or Firm* — Muncy, Geissler, Olds & Lowe, P.C.

(57) ABSTRACT

The woven cloth is formed by a plurality of longitudinal threads and a plurality of lateralwise threads. Each longitudinal thread is woven by a plurality of filaments. Each lateralwise thread is interwoven with and ties the plurality of longitudinal threads. The woven cloth includes a non-woven section and two woven sections which are connected with two ends of the non-woven section. Each woven section includes at least two of the plurality of lateralwise threads which are adjacent to each other. In an extending direction in which the longitudinal threads extend, a span of the non-woven section is greater than a gap span between adjacent two of the lateralwise threads of respective one of the two woven sections.

10 Claims, 3 Drawing Sheets

(56) References Cited

U.S. PATENT DOCUMENTS 4,651,620 A * 3/1987 Lyons ..... D04G 1/08 289/1.2
5,098,764 A * 3/1992 Bassett ..... C09J 4/00 428/131
5,238,728 A * 8/1993 Aucagne ..... B29C 70/24 428/109
5,601,907 A * 2/1997 Matsumoto ..... D03D 3/00 428/131
5,662,147 A * 9/1997 Haiber ..... D03D 11/02 139/384 R
5,795,835 A * 8/1998 Bruner ..... D04B 21/12 442/310
5,865,464 A * 2/1999 Kanuma ..... B60R 21/235 280/743.1
6,767,615 B1 * 7/2004 Judkins ..... B31D 3/0215 156/290
7,287,553 B2 * 10/2007 Wahhoud ..... D03C 7/06 139/101
7,348,285 B2 * 3/2008 Dhawan ..... D02G 3/38 174/107
2003/0056846 A1 * 3/2003 Buesgen ..... B60R 21/18 139/1 R
2004/0057176 A1 * 3/2004 Dhawan ..... D02G 3/38 361/62
2004/0065380 A1 * 4/2004 Speich ..... D03C 19/005 139/383 R
2004/0185734 A1 * 9/2004 Gray ..... B29C 70/22 442/312
2006/0107701 A1 * 5/2006 Ternon ..... D04B 21/165 66/195
2006/0110995 A1 * 5/2006 Ternon ..... D04B 21/14 442/59
2008/0042115 A1 * 2/2008 Karatzis ..... D03C 7/06 256/1
2008/0287022 A1 * 11/2008 Dhawan ..... D02G 3/38 442/229
2009/0199336 A1 * 8/2009 Gentile ..... A47G 9/0223 5/486
2009/0317569 A1 * 12/2009 Debaes ..... A41G 1/009 428/17
2011/0185620 A1 * 8/2011 Momoi ..... A01K 75/00 43/9.95
2012/0232655 A1 * 9/2012 Lorrison ..... A61F 2/0045 623/13.19
2012/0291908 A1 * 11/2012 Lama ..... D03D 27/00 139/400
2014/0326267 A1 * 11/2014 Peterson ..... A41G 5/0046 132/201
2014/0338784 A1 * 11/2014 Lama ..... D03D 27/00 139/400
2016/0081411 A1 * 3/2016 Shin ..... A41G 3/0041 132/201
2017/0130371 A1 * 5/2017 Harabayashi ..... D03D 11/02
2017/0145608 A1 * 5/2017 Ko ..... D04B 21/10

* cited by examiner

WOVEN CLOTH

BACKGROUND OF THE INVENTION

Field of the Invention

The present invention relates to woven cloth.

Description of the Prior Art

Conventional woven cloth is shown in patents TW M455021. The woven cloth is woven by threads along a longitudinal directions and a lateralwise direction. The threads must be woven tightly to prevent the cloth from deforming, but the gaps among the threads are too narrow so that the cloth cannot breathe well.

Cloth of a conventional leisure shoe or sport shoe has the above-mentioned defectiveness, and it has poor extensibility so that it is not allowed for quick wear-on or quick take-off for a foot and is uncomfortable for doing exercises such as walking or jogging or for long-termed wearing.

The present invention is, therefore, arisen to obviate or at least mitigate the above mentioned disadvantages.

SUMMARY OF THE INVENTION

An object of the present invention is to provide woven cloth which has a part being more stretchable than other part thereof.

To achieve the above and other objects, woven cloth is provided. The woven cloth is formed by a plurality of longitudinal threads and a plurality of lateralwise threads. Each of the plurality of longitudinal threads is woven by a plurality of filaments. Each of the plurality of lateralwise threads is interwoven with and ties the plurality of longitudinal threads. The woven cloth includes a non-woven section and two woven sections which are connected with two ends of the non-woven section. Each woven section includes at least two of the plurality of lateralwise threads which are adjacent to each other. In an extending direction in which the longitudinal threads extend, a span of the non-woven section is greater than a gap span between adjacent two of the lateralwise threads of respective one of the two woven sections.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
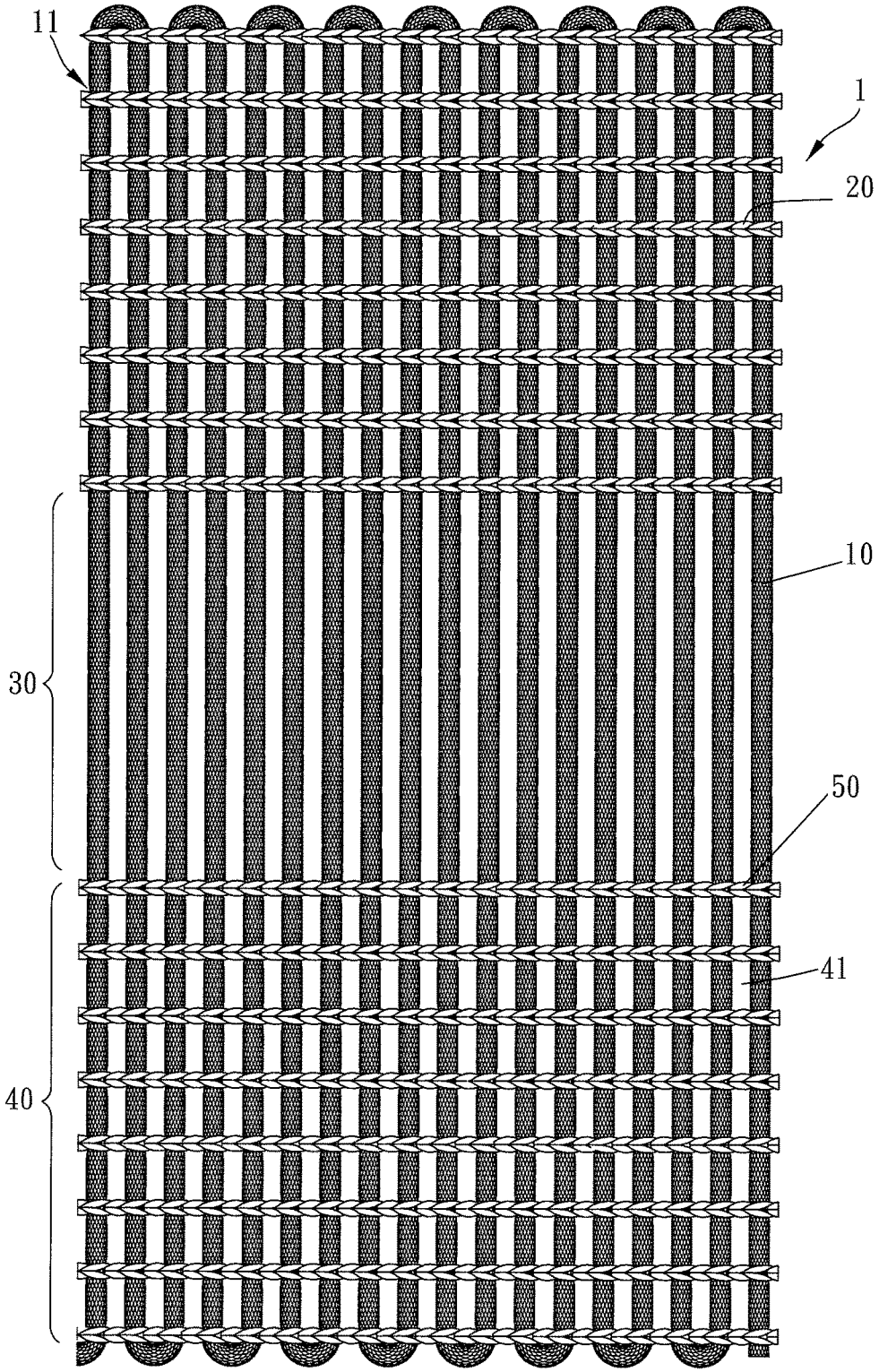
FIG. 1 is a plan view according to a preferred embodiment of the present invention.
Figure 2:
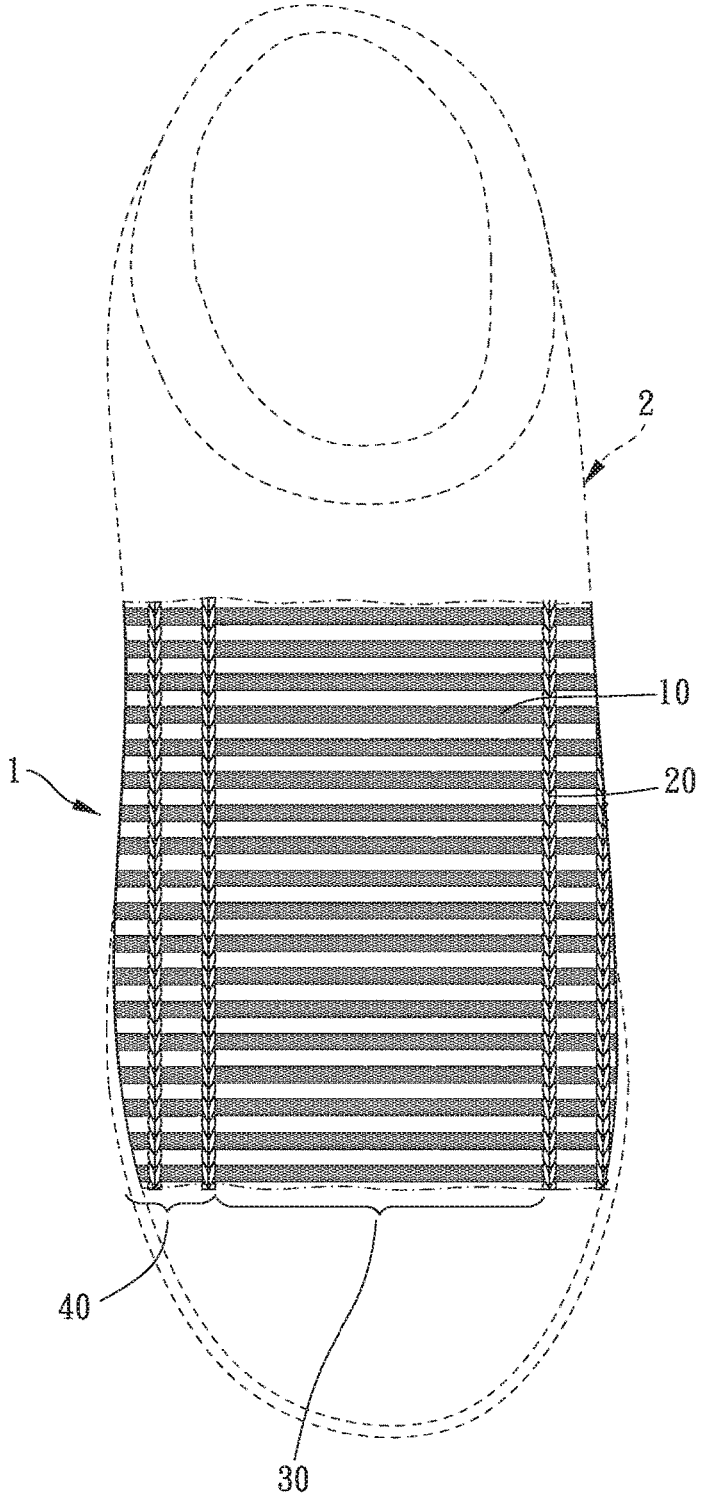
FIG. 2 is a top view of an application according to a preferable embodiment of the present invention.
Figure 3:
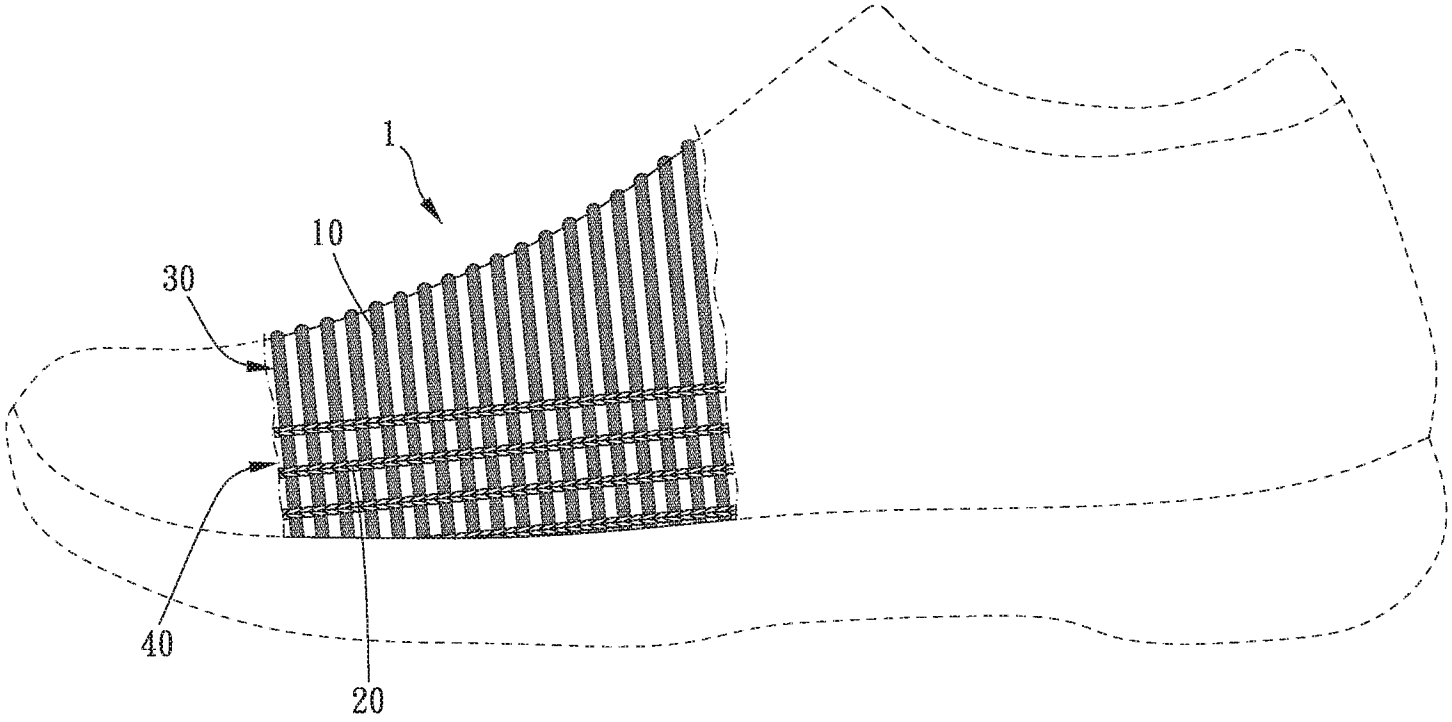
FIG. 3 is a side view of an application according to a preferable embodiment of the present invention.

FIGS. 1-3 show woven cloth according to a preferred embodiment of the present invention. The woven cloth 1 is formed by a plurality of longitudinal threads 10 (such as warp threads) and a plurality of lateralwise threads (such as weft threads) 20, each of the plurality of longitudinal threads 10 is woven by a plurality of filaments, each of the plurality of lateralwise threads 20 is interwoven with and ties the plurality of longitudinal threads 10 (for example, the lateralwise thread and the longitudinal thread are knotted with each other), the woven cloth 1 includes a non-woven section 30 and two woven sections 40 which are connected with two ends of non-woven section 30, and each woven section 40 includes at least two of the plurality of lateralwise threads 20 which are adjacent to each other. In an extending direction in which the longitudinal threads 10 extend, a span of the non-woven section 30 is greater than a gap span between adjacent two of the woven section 40 the plurality of lateralwise threads 20 of respective one of the two woven sections 40. Whereby, the woven cloth is integrally manufactured has a part being more stretchable than other part thereof. Wherein each of the plurality of lateralwise threads 20 ties around respective one of the plurality of longitudinal threads 10 and knots itself; and each of the plurality of longitudinal threads 10 includes radially-contracting portions 11 where the plurality of lateralwise threads 20 tie around.

In this embodiment, in the extending direction, the span of the non-woven section 30 is greater than two times the gap span between adjacent two of the plurality of lateralwise threads 20 of respective one of the two woven sections 40, so that the non-woven section 30 can provide good extensibility and flexibility and reduce pressure onto the foot, and the woven section 40 provides good support. Additionally, in the extending direction, the span of the non-woven section 30 is greater than 1.5 times a span of respective one of the two woven sections 40.

In this embodiment, in the extending direction, the two woven sections 40 are the same in size, and as it is applied to an upper of a shoe, for example, it has two side parts having balanced support. In other embodiment, the two woven sections 40 may be different in size.

In this embodiment, a single thread is zigzagged to form the plurality of longitudinal threads 10, thus having good structural strength and being capable of bearing large stress exerted thereto, and preventing the plurality of longitudinal threads 10 and the plurality of lateralwise threads 20 from being broken. Preferably, the plurality of longitudinal threads 10 are arranged in parallel, and the plurality of longitudinal threads 10 are arranged equidistantially from one another, thus providing multi-dimensional stretchability. Specifically, the span of the non-woven section 30 is greater than two times an interval between adjacent two of the plurality of longitudinal threads 10; wherein each of the plurality of lateralwise threads 20 itself knots to form a plurality of knots 50, and each of the plurality of knots 50 is located between and separates two adjacent ones of the longitudinal threats 10.

In this embodiment, each of the plurality of longitudinal threads 10 is greater than each of the plurality of lateralwise threads 20 in outer diameter; each of the plurality of longitudinal threads 10 has an outer diameter greater than 3 times an outer diameter of each of the plurality of lateralwise threads 20; in this embodiment, the outer diameter of each of the plurality of longitudinal threads 10 is between 0.10 cm to 0.30 cm, and the outer diameter of each of the plurality of lateralwise threads 20 is between 0.01 cm to 0.10 cm, so that each of the plurality of longitudinal threads 10 has good tension strength and is not easy to break.

Each of the plurality of longitudinal threads 10 is greater than each of the plurality of lateralwise threads 20 in extensibility. The plurality of longitudinal threads 10 with relatively high extensibility provide good flexibility and stretchability, while the plurality of lateralwise threads 20 with relatively low extensibility can hold the plurality of longitudinal threads 10 in position.

The plurality of longitudinal threads 10 and the plurality of lateralwise threads 20 are interwoven to form a plurality of meshes 41 in respective one of the two woven sections 40, and the meshes 41 allow ventilation and resulting in a light weight.

The woven cloth may be applied to a shoe, protective equipment and/or clothing. As the woven cloth is applied to an upper of a shoe 2 (as shown in FIGS. 2 and 3), for example, the plurality of longitudinal threads 10 with relatively high extensibility allow quick wear-on or quick take-off for a foot, and it is comfortable for doing exercises.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A woven cloth, formed by a plurality of longitudinal threads and a plurality of lateralwise threads, each of the plurality of longitudinal threads being woven by a plurality of filaments, each of the plurality of lateralwise threads being interwoven with and ties the plurality of longitudinal threads, the woven cloth including a non-woven section and two woven sections which are connected with two ends of the non-woven section, each woven section including at least two of the plurality of lateralwise threads which are adjacent to each other;

wherein in an extending direction in which the longitudinal threads extend, a span of the non-woven section is greater than a gap span between adjacent two of the plurality of lateralwise threads of respective one of the two woven sections;

wherein each of the plurality of lateralwise threads ties around respective one of the plurality of longitudinal threads and knots itself; and each of the plurality of longitudinal threads includes radially-contracting portions where the plurality of lateralwise threads tie around.

2. The woven cloth of claim 1, wherein in the extending direction, the span of the non-woven section is greater than two times the gap span between adjacent two of the plurality of lateralwise threads of respective one of the two woven sections.

3. The woven cloth of claim 1, wherein in the extending direction, the span of the non-woven section is greater than 1.5 times a span of respective one of the two woven sections.

4. The woven cloth of claim 1, wherein in the extending direction, the two woven sections are the same in size.

5. The woven cloth of claim 1, wherein a single thread is zigzagged to form the plurality of longitudinal threads.

6. The woven cloth of claim 1, wherein the plurality of longitudinal threads are arranged in parallel; wherein each of the plurality of lateralwise threads itself knots to form a plurality of knots, and each of the plurality of knots is located between and separates two adjacent ones of the longitudinal threads.

7. The woven cloth of claim 1, wherein the plurality of longitudinal threads are arranged equidistantially from one another.

8. The woven cloth of claim 7, wherein the span of the non-woven section is greater than two times an interval between adjacent two of the plurality of longitudinal threads.

9. The woven cloth of claim 1, wherein the plurality of longitudinal threads and the plurality of lateralwise threads are interwoven to form a plurality of meshes in respective one of the woven sections.

10. The woven cloth of claim 8, wherein in the extending direction, the span of the non-woven section is greater than two times the gap span between adjacent two of the lateralwise threads of respective one of the two woven sections; in the extending direction, the span of the non-woven section is greater than 1.5 times a span of respective one of the woven sections; in the extending direction, the two woven sections are the same in size; the plurality of longitudinal threads are arranged in parallel; the plurality of longitudinal threads and the plurality of lateralwise threads are interwoven to form a plurality of meshes in respective one of the two woven sections; each of the plurality of longitudinal threads is greater than each of the plurality of lateralwise threads in outer diameter; each of the plurality of longitudinal threads has an outer diameter greater than 3 times an outer diameter of each of the plurality of lateralwise threads; the outer diameter of each of the plurality of longitudinal threads is between 0.10 cm to 0.30 cm, and the outer diameter of each of the plurality of lateralwise threads is between 0.01 cm to 0.10 cm; a single thread is zigzagged to formed the plurality of longitudinal threads; each of the plurality of longitudinal threads is greater than each of the plurality of lateralwise threads in extensibility.

* * * * *